US010948165B1

(12) United States Patent
Hsu

(10) Patent No.: US 10,948,165 B1
(45) Date of Patent: Mar. 16, 2021

(54) WATERPROOF CRANKSHAFT LAMP WITH ADJUSTABLE FOCUS

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/922,126

(22) Filed: Jul. 7, 2020

(51) Int. Cl.
*F21V 14/02* (2006.01)
*F21V 31/00* (2006.01)
*F21V 5/00* (2018.01)

(52) U.S. Cl.
CPC ..... *F21V 14/02* (2013.01); *F21V 31/005* (2013.01); *F21V 5/00* (2013.01)

(58) Field of Classification Search
CPC ..... F21V 14/02; F21V 14/06; F21V 31/005; F21V 5/00
See application file for complete search history.

(56) References Cited

U.S. PATENT DOCUMENTS

2013/0208481 A1* 8/2013 Sooferian ..... F21V 14/06 362/280
2015/0070889 A1* 3/2015 Sooferian ..... F21V 17/06 362/232
2018/0045397 A1* 2/2018 Sooferian ..... F21V 17/06

* cited by examiner

*Primary Examiner* — Karabi Guharay
(74) *Attorney, Agent, or Firm* — Karin L. Williams; Alan D. Kamrath; Mayer & Williams PC

(57) ABSTRACT

A lamp includes a housing, an adjusting knob, a sliding unit, a light source, and a lens. The housing is provided with a light output opening. The adjusting knob is mounted on the housing. The sliding unit is mounted in the housing and includes a sliding bracket which is provided with an elongate adjusting slot. A driving crankshaft is mounted on the adjusting knob and is located at a position deviated from a center of the adjusting knob. The driving crankshaft extends into the adjusting slot of the sliding unit. The light source is secured to the sliding unit and faces the lens. The lens is located in the light output opening of the housing.

7 Claims, 5 Drawing Sheets

WATERPROOF CRANKSHAFT LAMP WITH ADJUSTABLE FOCUS

BACKGROUND OF THE INVENTION

1. Field of the Invention

The present invention relates to an illuminating apparatus and, more particularly, to a lamp.

2. Description of the Related Art

A conventional lamp includes a lighting module to provide an illuminating function. In practice, the user may need various lamps with different lighting angles to provide diverse lighting effects so as to fit different scenes. However, the conventional lamp has a fixed light output angle such that the focus of the conventional lamp cannot be adjusted according to the user's different requirements, thereby limiting the versatility of the conventional lamp. Thus, the user has to purchase multiple lamps with different lighting angles so as to provide diverse lighting effects, thereby greatly increasing the cost.

BRIEF SUMMARY OF THE INVENTION

The primary objective of the present invention is to provide a waterproof lamp with adjustable focuses.

In accordance with the present invention, there is provided a lamp comprising a housing, an adjusting knob, a sliding unit, a light source, and a lens. The housing is provided with a light output opening. The adjusting knob is mounted on the housing. The sliding unit is mounted in the housing. The sliding unit is connected with the adjusting knob. The sliding unit includes a sliding bracket. The sliding bracket of the sliding unit is provided with an elongate adjusting slot which extends leftward and rightward. The adjusting slot of the sliding unit extends in a direction that is perpendicular to a light output direction. A driving crankshaft is mounted on the adjusting knob and is located at a position deviated from a center of the adjusting knob. The driving crankshaft extends into the adjusting slot of the sliding unit. The light source is mounted in the housing. The light source is secured to the sliding unit and faces the lens. The lens is mounted in the housing. The lens is located in the light output opening of the housing.

According to the primary advantage of the present invention, the focus of the lamp is adjusted so as to satisfy the user's different requirements.

According to another advantage of the present invention, the focus of the lamp is adjusted easily by rotating the adjusting knob, thereby facilitating the user adjusting the focus of the lamp.

According to a further advantage of the present invention, the lamp has a simplified construction to decrease the cost of production.

According to a further advantage of the present invention, the lamp has a waterproof function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
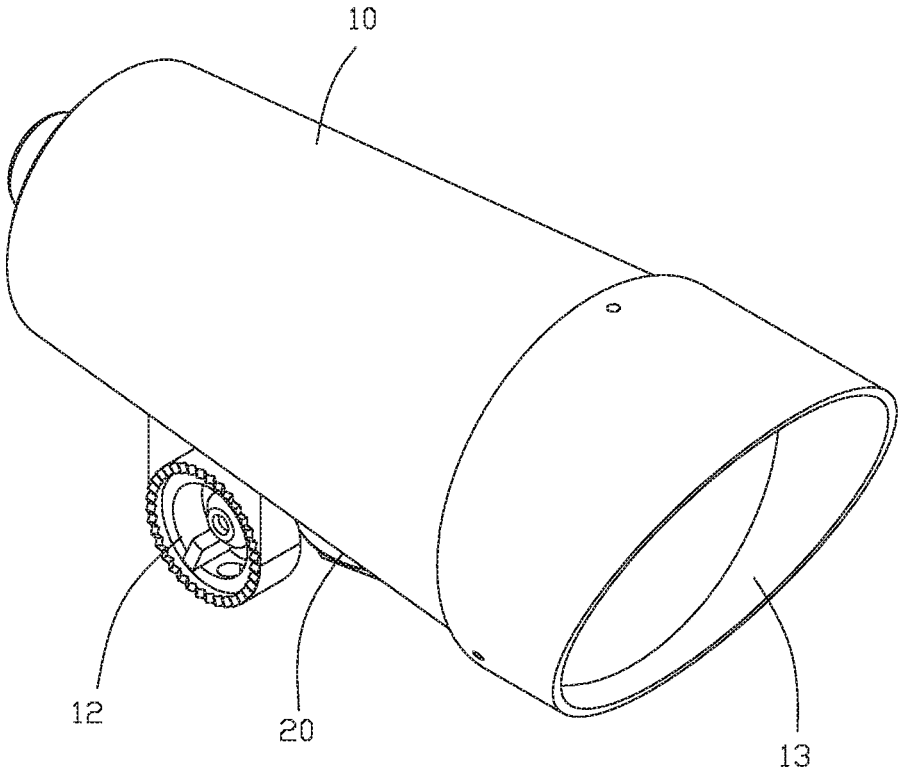
FIG. 1 is a perspective view of a lamp in accordance with the preferred embodiment of the present invention.
Figure 2:
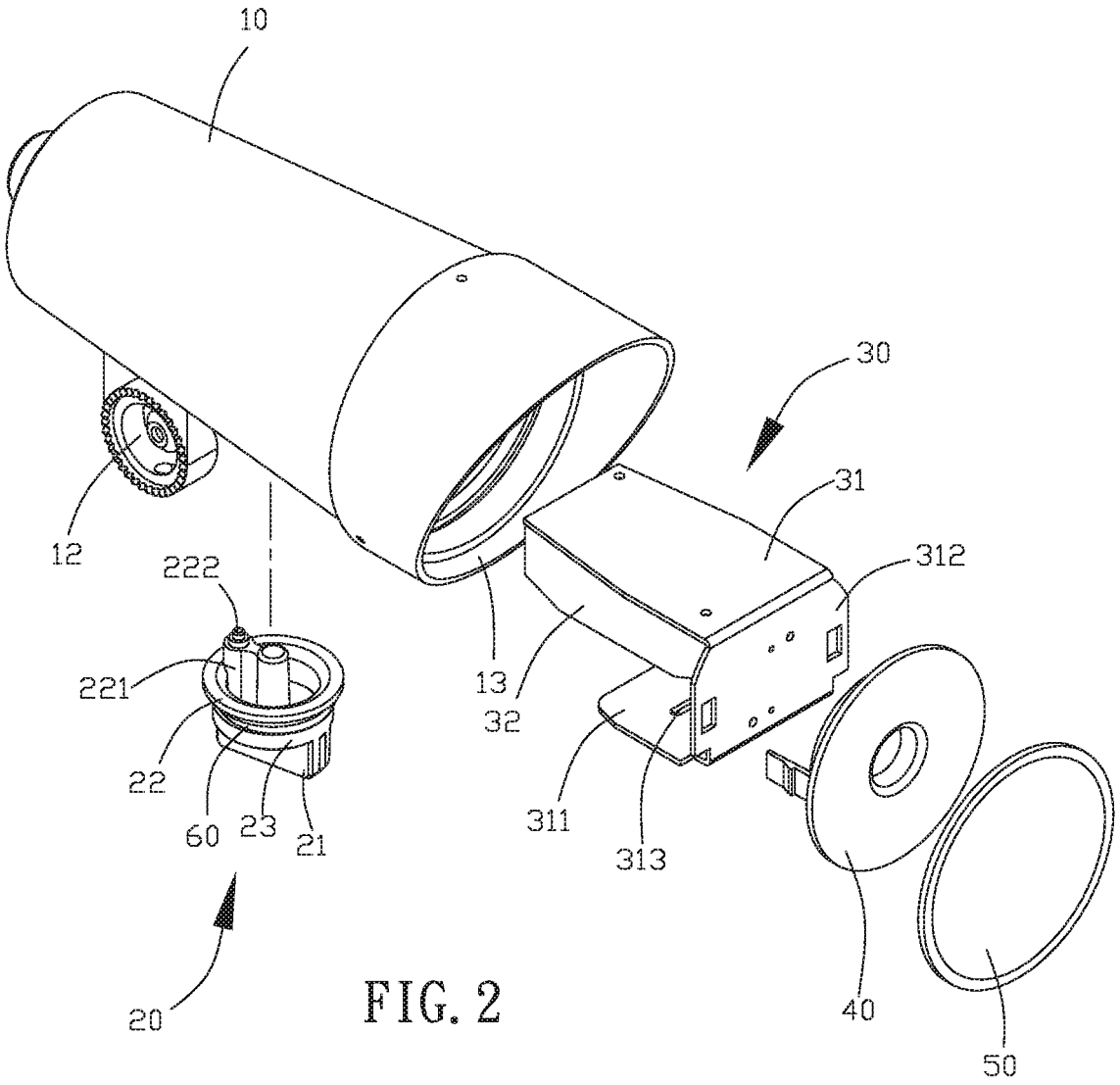
FIG. 2 is an exploded perspective view of the lamp in accordance with the preferred embodiment of the present invention.
Figure 3:
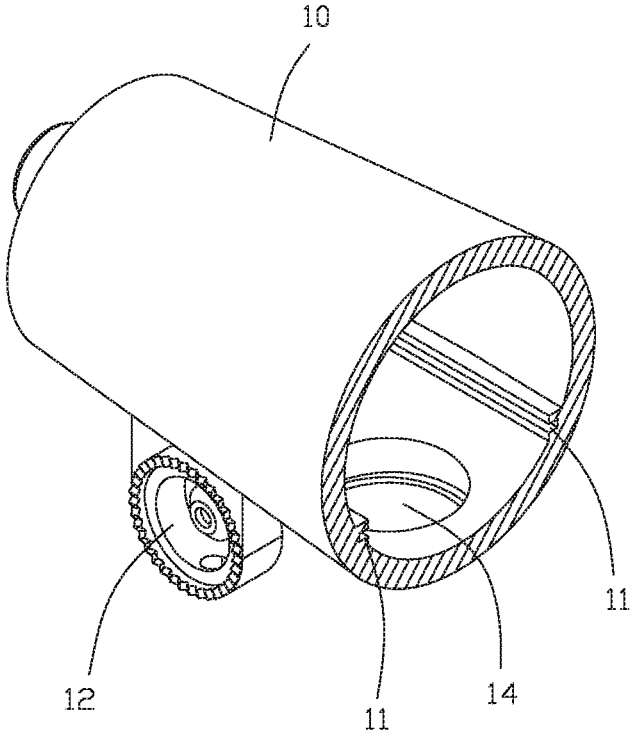
FIG. 3 is a perspective cross-sectional view of a housing of the lamp in accordance with the preferred embodiment of the present invention.
Figure 4:
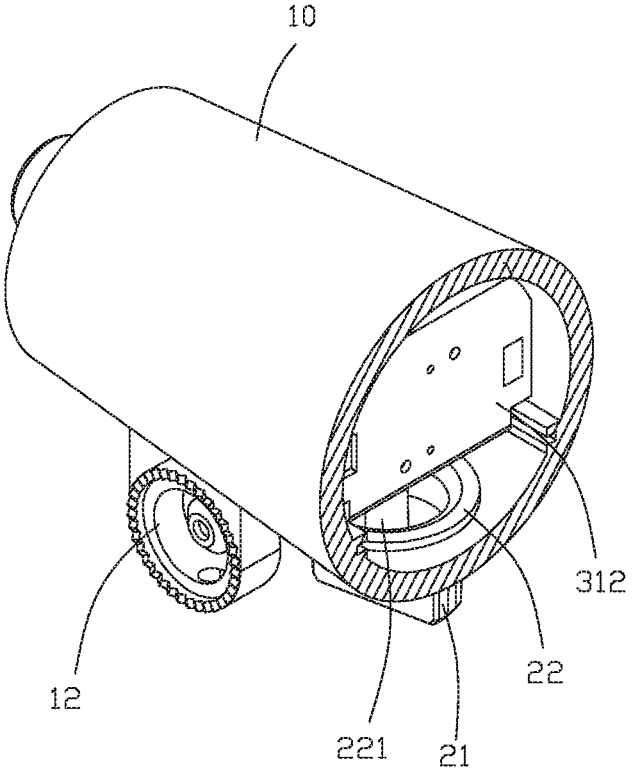
FIG. 4 is a partial perspective cross-sectional view of the lamp in accordance with the preferred embodiment of the present invention.
Figure 5:
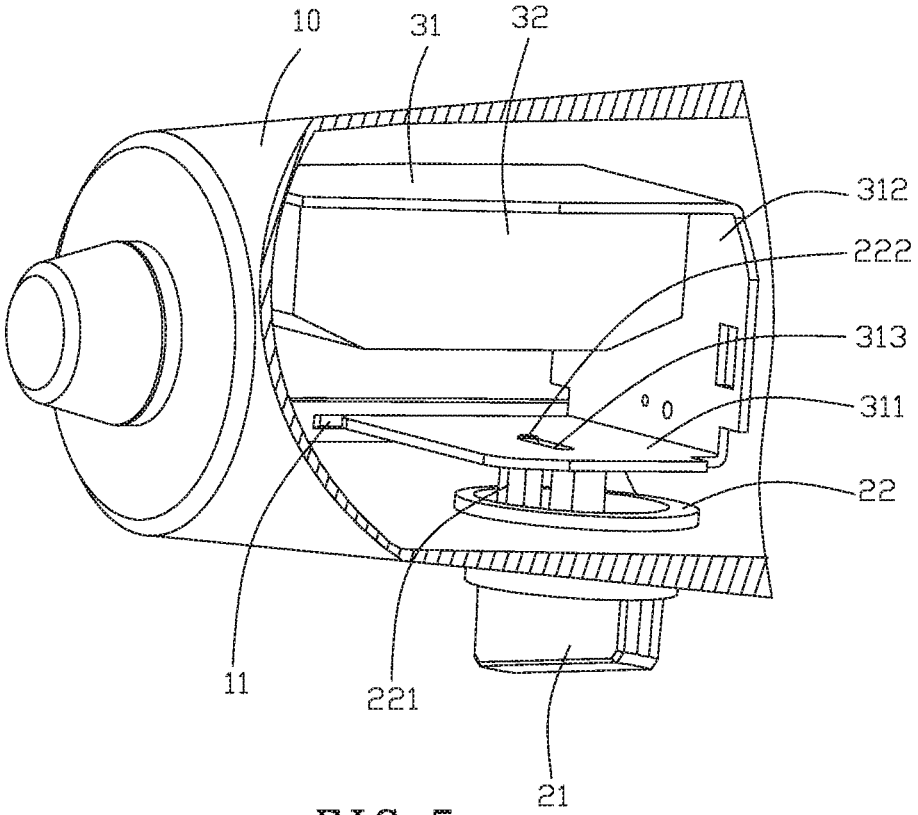
FIG. 5 is another partial perspective cross-sectional view of the lamp in accordance with the preferred embodiment of the present invention.
Figure 6:
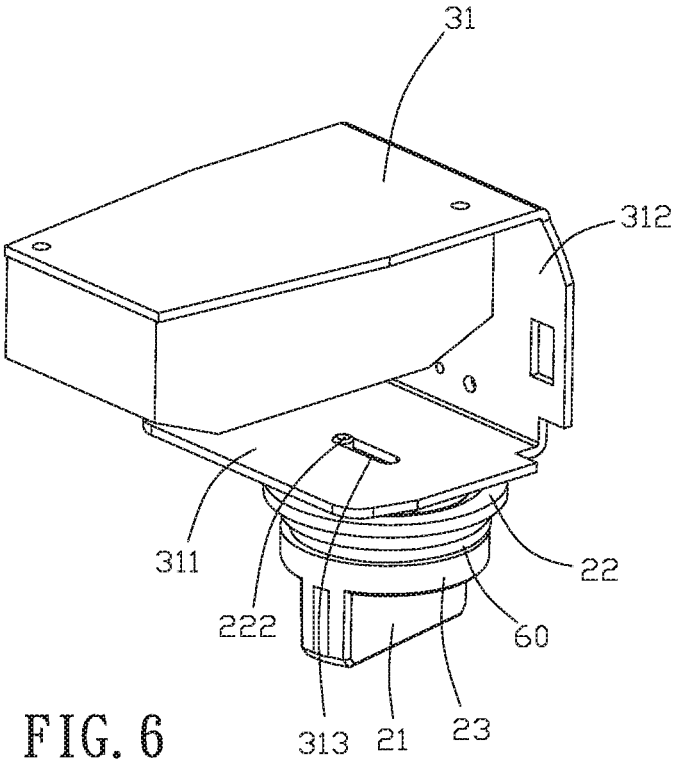
FIG. 6 is a partial perspective view of the lamp in accordance with the preferred embodiment of the present invention.
Figure 7:
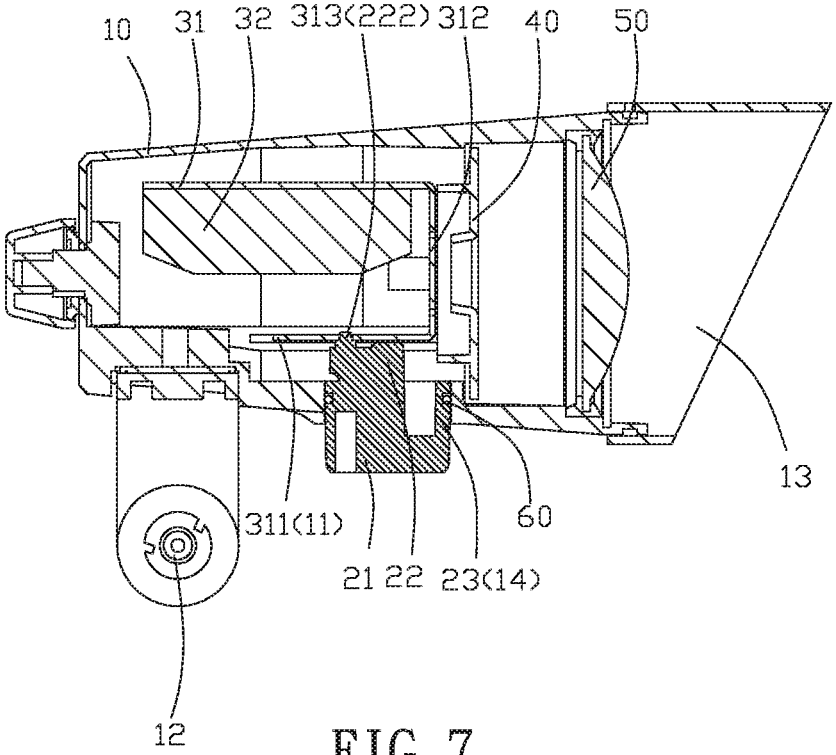
FIG. 7 is a planar cross-sectional view of the lamp in accordance with the preferred embodiment of the present invention.

Referring to FIGS. 1-7, a lamp in accordance with the preferred embodiment of the present invention comprises a housing 10, an adjusting knob 20, a sliding unit 30, a light source 40, and a lens 50.

The housing 10 is provided with a light output opening 13. The adjusting knob 20 is rotatably mounted on the housing 10. The adjusting knob 20 is located outside of the housing 10 and extends into the sliding unit 30. The sliding unit 30 is movably mounted in the housing 10. The sliding unit 30 is connected with the adjusting knob 20. The sliding unit 30 includes a sliding bracket 31. The sliding bracket 31 of the sliding unit 30 is provided with an elongate adjusting slot 313 which extends leftward and rightward. The adjusting slot 313 of the sliding unit 30 extends in a direction that is perpendicular to a light output direction. A driving crankshaft 222 is mounted on the adjusting knob 20 and is located at a position deviated from a center of the adjusting knob 20. The driving crankshaft 222 extends into and is slidably mounted in the adjusting slot 313 of the sliding unit 30. Alternatively, the driving crankshaft 222 engages a side of the adjusting slot 313 of the sliding unit 30. The light source 40 is mounted in the housing 10. The light source 40 is secured to the sliding unit 30 and faces the lens 50. The light source 40 is driven by the sliding unit 30 to move relative to the lens 50. The light source 40 is arranged between the sliding unit 30 and the lens 50. The lens 50 is mounted in the housing 10. The lens 50 is located in the light output opening 13 of the housing 10. The lens 50 is arranged between the light source 40 and the light output opening 13 of the housing 10.

In practice, when the adjusting knob 20 is rotated, the sliding unit 30 is moved by rotation of the adjusting knob 20 and drives the light source 40 to move forward or backward relative to the lens 50, so as to regulate different focuses of the light source 40 on the lens 50.

In the preferred embodiment of the present invention, the adjusting knob 20 includes an adjusting portion 21 and a limit portion 22. The adjusting portion 21 of the adjusting knob 20 is located outside of the housing 10. The limit portion 22 of the adjusting knob 20 is located inside of the housing 10. The driving crankshaft 222 is mounted on and partially protrudes outward from the limit portion 22 of the adjusting knob 20. The driving crankshaft 222 is rotated by the adjusting knob 20 and is movable in the adjusting slot 313 of the sliding unit 30.

In the preferred embodiment of the present invention, the housing 10 has a bottom wall provided with a through hole 14. The through hole 14 penetrates the bottom wall of the housing 10. The adjusting knob 20 further includes a connecting portion 23 connecting the adjusting portion 21 and the limit portion 22. The connecting portion 23 of the adjusting knob 20 extends through and is rotatably mounted in the through hole 14 of the housing 10. The connecting portion 23 of the adjusting knob 20 is arranged between the adjusting portion 21 and the limit portion 22.

In the preferred embodiment of the present invention, the housing 10 is provided with two opposite slideways 11. The sliding bracket 31 of the sliding unit 30 has two opposite sides slidably mounted in the two slideways 11 of the housing 10.

In the preferred embodiment of the present invention, the sliding bracket 31 of the sliding unit 30 includes a bottom plate 311 and a side plate 312 located at a side of the bottom plate 311. The adjusting slot 313 of the sliding unit 30 is formed in the bottom plate 311. The light source 40 is secured to the side plate 312. The bottom plate 311 has two opposite sides slidably mounted in the two slideways 11 of the housing 10. The light source 40 and the lens 50 are arranged opposite.

In the preferred embodiment of the present invention, the limit portion 22 of the adjusting knob 20 has a top provided with a cam 221, and the driving crankshaft 222 is mounted on a rim of a top face of the cam 221.

In the preferred embodiment of the present invention, the limit portion 22 of the adjusting knob 20 has a bottom abutting a bottom face of an interior of the housing 10. An O-ring 60 is mounted on an outer face of the connecting portion 23 and is pressed between the limit portion 22 of the adjusting knob 20 and the housing 10 to provide a waterproof sealing effect.

In the preferred embodiment of the present invention, the housing 10 is provided with a mounting portion 12 for mounting the housing 10 on an object, such as a lamp support, a lamp holder or the like.

In the preferred embodiment of the present invention, the sliding unit 30 further includes a power supply (or an electric appliance) 32 mounted on the sliding bracket 31 and electrically connected with the light source 40.

In the preferred embodiment of the present invention, the power supply 32 is secured to the side plate 312 which is located between the power supply 32 and the light source 40.

In operation, when the adjusting knob 20 is rotated, the cam 221 is driven and rotated by the adjusting knob 20. Then, the cam 221 drives and rotates the driving crankshaft 222. Then, the driving crankshaft 222 drives the adjusting slot 313 of the sliding unit 30. In such a manner, the driving crankshaft 222 is moved leftward and rightward in the adjusting slot 313 of the sliding unit 30 during rotation of the adjusting knob 20, and drives the sliding bracket 31 of the sliding unit 30 to reciprocatingly move forward and backward. Thus, the light source 40 is driven by the sliding bracket 31 of the sliding unit 30 to reciprocatingly move forward and backward relative to the lens 50, so as to adjust the distance between the light source 40 and the lens 50, such that the focus of the lamp is adjusted according to the user's demand Accordingly, the focus of the lamp is adjusted so as to satisfy the user's different requirements.

In addition, the focus of the lamp is adjusted easily by rotating the adjusting knob 20, thereby facilitating the user adjusting the focus of the lamp.

Further, the lamp has a simplified construction to decrease the cost of production.

Further, the lamp has a waterproof function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A lamp comprising:

a housing, an adjusting knob, a sliding unit, a light source, and a lens;

wherein:

the housing is provided with a light output opening;

the adjusting knob is mounted on the housing;

the sliding unit is mounted in the housing;

the sliding unit is connected with the adjusting knob;

the sliding unit includes a sliding bracket;

the sliding bracket of the sliding unit is provided with an elongate adjusting slot which extends leftward and rightward;

the adjusting slot of the sliding unit extends in a direction that is perpendicular to a light output direction;

a driving crankshaft is mounted on the adjusting knob and is located at a position deviated from a center of the adjusting knob;

the driving crankshaft extends into the adjusting slot of the sliding unit;

the light source is mounted in the housing;

the light source is secured to the sliding unit and faces the lens;

the lens is mounted in the housing; and the lens is located in the light output opening of the housing.

2. The lamp as claimed in claim 1, wherein:

the adjusting knob includes an adjusting portion and a limit portion;

the adjusting portion of the adjusting knob is located outside of the housing;

the limit portion of the adjusting knob is located inside of the housing; and the driving crankshaft is mounted on the limit portion of the adjusting knob.

3. The lamp as claimed in claim 2, wherein:

the housing has a bottom wall provided with a through hole;

the adjusting knob further includes a connecting portion connecting the adjusting portion and the limit portion; and the connecting portion of the adjusting knob extends through the through hole of the housing.

4. The lamp as claimed in claim 2, wherein the limit portion of the adjusting knob has a top provided with a cam, and the driving crankshaft is mounted on a rim of a top face of the cam.

5. The lamp as claimed in claim 2, wherein:

the limit portion of the adjusting knob has a bottom abutting a bottom face of an interior of the housing; and an O-ring is mounted on an outer face of the connecting portion.

6. The lamp as claimed in claim 1, wherein the housing is provided with two opposite slideways, and the sliding bracket of the sliding unit has two opposite sides slidably mounted in the two slideways of the housing.

7. The lamp as claimed in claim 1, wherein:

the sliding bracket of the sliding unit includes a bottom plate and a side plate located at a side of the bottom plate;

the adjusting slot of the sliding unit is formed in the bottom plate;

the light source is secured to the side plate; and the light source and the lens are arranged opposite.

* * * * *